US009110445B2

(12) United States Patent
Courvoisier et al.

(10) Patent No.: US 9,110,445 B2
(45) Date of Patent: Aug. 18, 2015

(54) CONTROL MECHANISM WITH A SECURELY REMOVABLE STEM

(71) Applicant: ETA SA Manufacture Horlogere Suisse, Grenchen (CH)

(72) Inventors: Raphael Courvoisier, Corcelles (CH); Christian Rufenacht, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/584,520

(22) Filed: Dec. 29, 2014

(65) Prior Publication Data

US 2015/0205265 A1 Jul. 23, 2015

(30) Foreign Application Priority Data

Jan. 23, 2014 (EP) ..... 14152221

(51) Int. Cl.
*G04B 27/02* (2006.01)
*G04B 27/06* (2006.01)

(52) U.S. Cl.
CPC ..... *G04B 27/02* (2013.01); *G04B 27/06* (2013.01)

(58) Field of Classification Search
CPC ..... G04B 27/06; G04B 27/008; G04B 27/00; G04B 27/02; G04B 27/04
USPC ..... 368/190, 194, 216, 288
See application file for complete search history.

(56) References Cited

U.S. PATENT DOCUMENTS

| | | | | | |
|---|---|---|---|---|---|
| 387,306 | A | * | 8/1888 | Keller | 368/196 |
| 492,612 | A | * | 2/1893 | Nunamaker | 368/198 |
| 2,872,776 | A | * | 2/1959 | Erard | 368/190 |
| 2,982,085 | A | * | 5/1961 | Meyer | 368/199 |
| 4,020,627 | A | * | 5/1977 | Yoshida et al. | 368/84 |

FOREIGN PATENT DOCUMENTS

| | | |
|---|---|---|
| CH | 129340 | 12/1928 |
| CH | 130727 | 12/1928 |
| CH | 132961 | 5/1929 |
| CH | 134409 | 7/1929 |
| CH | 248035 | 4/1947 |
| CH | 260355 | 3/1949 |
| CH | 290361 | 4/1953 |

OTHER PUBLICATIONS

European Search Report issued Sep. 30, 2014, in European Application No. 14152221.9 filed Jan. 23, 2014 (with English Translation).

* cited by examiner

*Primary Examiner* — Sean Kayes
(74) *Attorney, Agent, or Firm* — Oblon, McClelland, Maier & Neustadt, L.L.P.

(57) ABSTRACT

Control mechanism for a timepiece movement, including, in a housing in a main plate, a control stem that is movable in a longitudinal direction and including a groove cooperating with a stud comprised in a pull-out piece for actuating the pivoting of the pull-out piece on the main plate, this pull-out piece is held in position by a jumper spring, and the mechanism including a bridge cooperating with the main plate to confine the stem, and this bridge includes a housing in which there is a movable limiter piston, arranged to abut on one end of a trunnion comprised in the pull-out piece under the application of a force in a transverse direction substantially orthogonal to the longitudinal direction, to allow the release of the stem after a given travel of the limiter piston.

13 Claims, 3 Drawing Sheets

CONTROL MECHANISM WITH A SECURELY REMOVABLE STEM

This application claims priority from European Patent application No. 14152221.9 filed Jan. 23, 2014, the entire disclosure of which disclosure of which is hereby incorporated herein by reference.

FIELD OF THE INVENTION

The invention concerns a control mechanism for a timepiece mechanism, including, in a housing of a main plate comprised in said mechanism, a control stem that is movable in a longitudinal direction, said stem including a groove cooperating with a stud comprised in a pull-out piece for actuating the pivoting of said pull-out piece on said plate, said pull-out piece being held in position by a jumper spring, and said mechanism including a bridge cooperating with said plate to confine said stem.

The invention further concerns a winding and time-setting mechanism including such a control mechanism.

The invention further concerns a timepiece movement including at least one control mechanism and/or winding and time-setting mechanism of this type.

The invention also concerns a watch including at least one such control mechanism and/or one such winding and time-setting mechanism and/or one such timepiece movement.

The invention concerns the field of timepiece control mechanisms, in particular for watches.

BACKGROUND OF THE INVENTION

When a watch is dismantled, the winding stem has to be removed before the movement can be taken out of the case. In general, it is necessary to press a pull-piece stud, which releases the various members of the stem mechanism from the actual stem.

When the watch is reassembled, the stem is reinserted, by pressing on the pull-piece stud again. However, the travel of the pull-piece stud is not generally blocked and it often occurs that the components of the stem mechanism leave their housing. In such case, the movement has to be removed from the case and dismantled for the stem mechanism to be able to be correctly assembled.

Further, the pull-out piece stud is generally close to the winding pinion, and there is consequently a risk of damaging the toothing with the tool used for removing the stem. In order to limit this risk, the tool entry point may be formed by an oblong hole or by a groove, which requires precise orientation of the tool, which is generally a screwdriver. If an unsuitable tool is used, the shaped hole is of no use. Further, the hole shape complicates and increases the cost of manufacturing the plate or bridge concerned, which would be simpler if a cylindrical hole were made.

Using a pull-out piece stud screwed into the pull-out piece results in an improvement. However, this pull-out piece stud does not actually limit the travel of the pull-out piece, since it has to be unscrewed to release the stem (instead being pressed as in ordinary mechanisms), and excessive unscrewing involves similar risks to the general case. This embodiment is also more expensive, because of the additional internal and external threads, and the fact of screwing in a component of very small size, which makes this embodiment difficult to use for small movements.

There is also known, from U.S. Pat. No. 1,087,525 in the name of BANNATYNE, a movement including connecting-pieces between the plate and the bridge, and wherein the shaft of the pull-out piece forms a connecting-piece in several parts, one of which carries a groove which holds the stamped pull-out piece, and is movable transversely with respect to the stem, to at least partially release the stem from a fork comprised in the pull-out piece in a plane perpendicular to the axis of the stem. This mechanism makes it possible to hold the components in the movement when the stem is dismantled, but is, however, expensive to manufacture, and requires significant space in the thickness of the movement.

CH Patent Application No 134409A in the name of SUTER & CIE UHRENFABRIK HAFIS discloses a winding and time-setting mechanism using a pull-out piece, wherein the pivot of the pull-out piece is formed by a stud that is movable along its axis within the frame of the movement, and disposed such that it is accessible from the rear face thereof, and can be actuated like a push-piece and pushed in with the pull-out piece comprised therein, against a return spring tending to ensure the assembly of the pull-out piece and the winding stem to each other.

CH Patent Application No 132861A in the name of MAMBRETTI MANLIO discloses a device for securing the time-setting pull-out piece, which includes a cylindrical stud, of which one end is screwed into the pull-out piece, and the other forms a head which projects several centimeters further than the barrel-bar to enable the winding stem to be removed simply by pressing on the head, the stud and pull-out piece being held in place by means of a plate forming a spring, which is secured to the main plate and abuts on the pull-out piece.

SUMMARY OF THE INVENTION

The invention proposes to improve a stem control mechanism, which is economical to manufacture, assemble and dismantle, with the possibility of easily removing the stem, with no risk of damaging nearby components, particularly toothings.

To this end, the invention proposes a control mechanism limiting the travel of the pull-out piece stud, via a travel limiter which offers a simple alternative (manufacture and assembly) to existing systems and, moreover, can convert an existing stem mechanism without any great modifications.

Also to this end, the invention concerns a control mechanism for a timepiece movement, including, in a housing of a main plate comprised in said mechanism, a control stem movable in a longitudinal direction, said stem including a groove cooperating with a stud comprised in a pull-out piece for actuating the pivoting of said pull-out piece on said main plate, said pull-out piece being held in position by a jumper spring, and said mechanism including a bridge cooperating with said main plate to confine said stem, characterized in that said control mechanism includes a means of limiting the travel of said stud of said pull-out piece, via a travel limiter including a limiter piston, said bridge includes a housing in which said limiter piston has limited mobility, arranged to abut on one end of a trunnion comprised in said pull-out piece under the application of a force in a transverse direction substantially orthogonal to said longitudinal direction, to permit the release of said stem after a given travel of said limiter piston, and characterized in that the mechanism includes a limiter bridge which is fixed or abuts on said bridge to immobilise and confine a head of said limiter piston within the limit of said travel.

In an alternative, the invention also concerns a control mechanism for a timepiece movement including, in a housing of a main plate comprised in said mechanism, a control stem movable in a longitudinal direction, said stem including a groove cooperating with a stud comprised in a pull-out piece for actuating the pivoting of said pull-out piece on said main plate, which is held in position by a jumper spring, and said mechanism including a bridge cooperating with said main plate to confine said stem, characterized in that said control mechanism includes a means of limiting the travel of said stud of said pull-out piece, via a travel limiter including a limiter piston, said bridge includes a housing in which said limiter piston has limited mobility, arranged to abut on one end of a trunnion comprised in said pull-out piece under the application of a force in a transverse direction substantially orthogonal to said longitudinal direction, to permit the release of said stem after a given travel of said limiter piston, and characterized in that said housing includes an internal thread arranged to cooperate with an external thread comprised in at least one part of the height of said limiter piston in said transverse direction, said limiter piston including a head for limiting said clearance travel thereof with respect to said bridge.

The invention further concerns a winding and time-setting mechanism including such a control mechanism.

The invention further concerns a timepiece movement including at least one control mechanism and/or winding and time-setting mechanism of this type.

The invention also concerns a watch including at least one such control mechanism and/or one such winding and time-setting mechanism and/or one such timepiece movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

The invention concerns the field of timepiece control mechanisms, in particular for watches.

The invention is illustrated here, in a non-limiting manner, in an application to a winding and time-setting mechanism 200.

Figure 6:
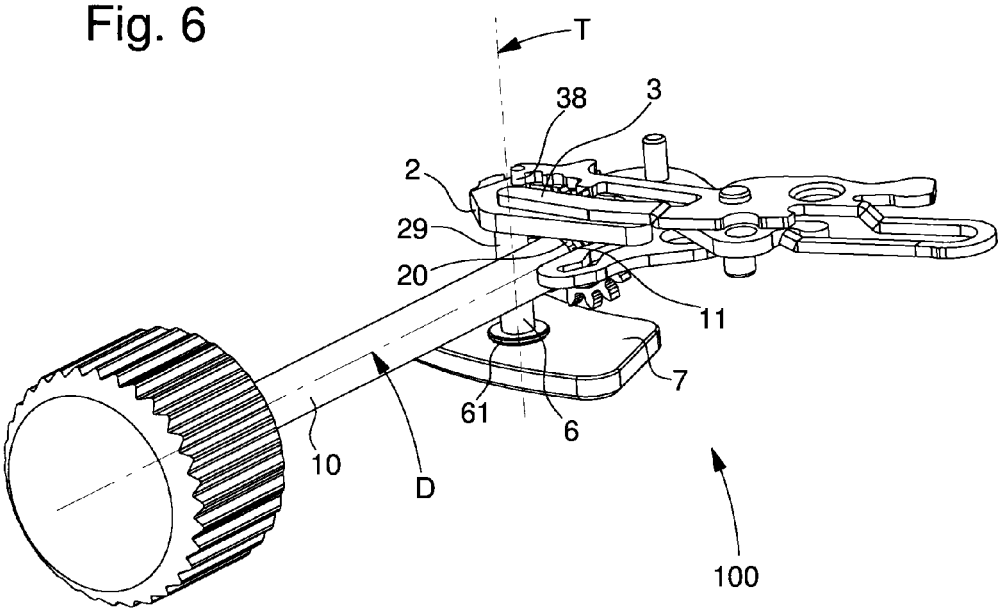
FIG. 6 shows a schematic perspective view, in the first variant of FIG. 1, of a detail of the cooperation between a pull-out piece stud and a groove of the stem on the one hand, and between the pull-out piece trunnion and the limiter piston on the other hand.

The invention concerns a control mechanism 100 for a timepiece movement. This control mechanism 100 includes a main plate 1, with a housing for receiving a control stem 10, which is movable in a longitudinal direction D. In the usual manner, this stem 10 is movable in translation in said direction D, and in rotation about the same axis. This stem 10 includes a groove 11, which cooperates with a stud 20 comprised in pull-out piece 2 for actuating the pivoting of said pull-out piece 2 on main plate 1. Pull-out piece 2 pivots, in a conventional manner, about a transverse axis T of substantially orthogonal direction to the longitudinal direction of stem 10, and is held in position by a jumper spring 3, which cooperates with a pin 38 of pull-out piece 2, as seen in FIG. 6. Pull-out piece 2 includes a trunnion 29, which is housed in a bore in main plate 1, to ensure the pivoting thereof. Mechanism 100 also includes a bridge 5, for example a barrel-bar, which cooperates with main plate 1 to confine stem 10. This bridge 5 includes a housing 54, which receives the end of trunnion 29 when stem 10 and pull-out piece 2 are in an operating position.

According to the invention, control mechanism 100 includes a limiter piston 6, which is movable, in a limited travel, in housing 54. This limiter piston 6 is arranged to abut, via an end 65 comprised therein, on one end 21 of trunnion 29 under the application of a force in transverse direction T, to allow the release of stem 10 after a given travel C of limiter piston 6.

This limiter piston has a limited travel. One advantage of the invention is that limiting the piston travel eliminates any risk of breaking the jumper spring when significant pressure is applied to the trunnion. The travel of the limiter piston can be limited in various manners.

Figure 1:
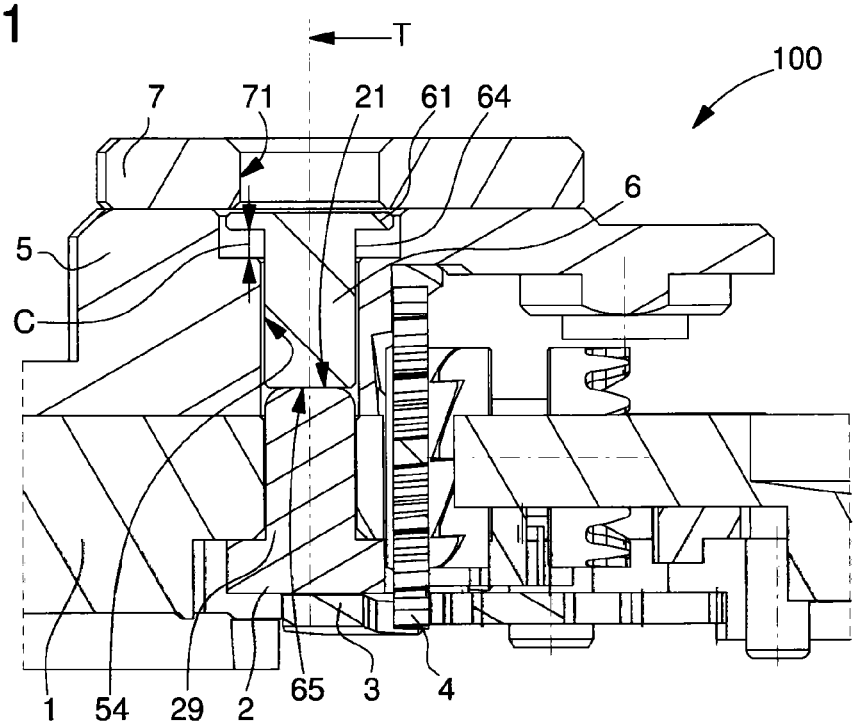
FIG. 1 shows a schematic cross-section of a first variant of a control mechanism according to the invention, including, in proximity to a pinion of a mechanism controlled by said control mechanism, a main plate with a housing for receiving a trunnion of a pull-out piece pushed by a jumper spring, on said main plate there is mounted a bridge including a housing, in which there is a movable limiter piston according to the invention, whose travel is limited by a limiter bridge.

In a first variant embodiment shown in FIGS. 1 and 6, mechanism 100 includes a limiter bridge 7, fixed to or abutting on bridge 5, to immobilise and confine a head 61 of limiter piston 6 in the limit of said travel C. This limiter bridge 7 may be fixed to main plate 1, or to another bridge, and simply abut on bridge 5. Preferably, this limiter bridge 7 includes an orifice 71 allowing the passage of a tool to apply a force in transverse direction T on limiter piston 6.

Limiter piston 6 includes, set back from head 61, a constricted portion 64, which forms the smallest diameter thereof; this constricted portion 64 is cylindrical in the particular example of the first variant of FIG. 1, and is movable in housing 54 of bridge 5.

Thus, limiter piston 6 forms an insert of very simple geometry and low production costs, which is inserted in the extraction hole in the stem. When the movement is removed from the case, pressure is thus exerted on the limiter piston.

Because of its geometry, it is not possible to move the limiter piston beyond its abutment area. The travel is therefore limited by head 61 of limiter piston 6.

Another advantage is that the point of contact between limiter piston 6 and the tool used is very far away from the various toothings of the winding mechanism, particularly from winding pinion 4 in the case of a winding and time-setting mechanism. There is therefore no risk of damage, even with an unsuitable tool. Consequently, the shaped hole, which is conventionally comprised in the bridge for orienting the tool in order to avoid this risk, is no longer necessary, and can be replaced by a simple circular machining operation, which simplifies the manufacture of the bridge.

In some cases, particularly for reasons of compactness or cost, it is not possible to block limiter piston 6 by an upper limiter bridge 7, as in the first variant. In those cases, it is possible to envisage internally threading the extraction hole, and partially externally threading the limiter piston. Thus, once engaged in the extraction hole, the limiter piston can no longer leave the hole without being unscrewed. Operation of the mechanism remains the same as for the first embodiment.

Figure 2:
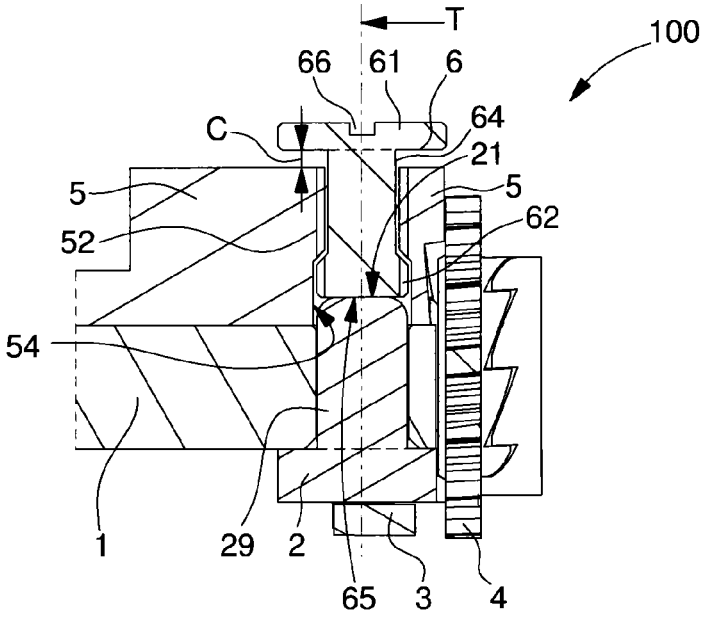
FIG. 2 shows, in a similar manner to FIG. 1, a second variant of the invention, with no limiter bridge, and wherein the bridge includes an internally threaded area above an enlarged chamber in proximity to the main plate, and wherein the limiter piston includes, on one part of the height thereof, an external thread arranged to cooperate with the internal thread, the externally threaded part of the limiter piston coming in immediate proximity to the pull-out piece trunnion.

In particular, in a second variant embodiment shown in FIG. 2, housing 54 includes an internal thread 52 arranged to cooperate with an external thread 62 comprised on at least part of the height of limiter piston 6, in transverse direction T; said limiter piston 6 includes a head 61 for limiting its clearance travel C with respect to bridge 5.

Preferably, external thread 62 and internal thread 52 are limited to an initial travel of limiter piston 6, remote from trunnion 29, after said initial travel, limiter piston 6 is free to pivot and come into contact with trunnion 29. The constricted portion 64 is located between head 61 and external thread 62 and slides freely into internal thread 52 of bridge 5.

Figure 3:
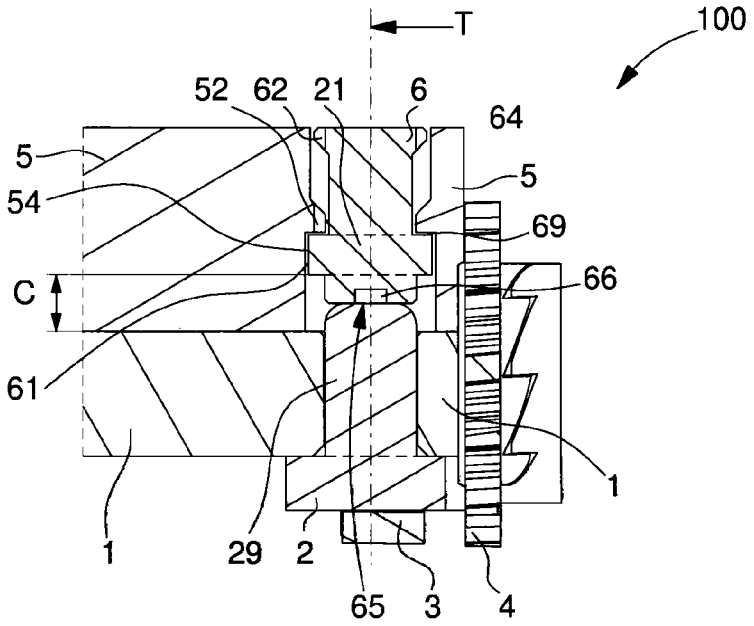
FIG. 3 shows, in a similar manner to FIG. 1, a third variant of the invention, which is inverted with respect to the second variant, with no limiter bridge, and wherein the bridge includes an internally threaded area above an enlarged chamber in proximity to the main plate, and wherein the limiter piston includes, on one part of the height thereof, an external thread arranged to cooperate with the internal thread, the externally threaded part of the limiter piston being remote from the pull-out piece trunnion, and the limiter piston including a collar confined inside the chamber located between the main plate and the internal thread of the bridge.

To prevent any confusion between limiter piston 6 and a screw to be loosened, it is possible to envisage inverting the arrangement so that the slot 66 preferably comprised in limiter piston 6 is not visible on the bridge side; thus, in a third variant, which is inverted with respect to this second variant, and as shown in FIG. 3, head 61 includes a collar 69, which is confined between internal thread 52 and main plate 1. The threaded area is used to facilitate assembly, by preventing limiter piston 6 from falling when bridge 5 is assembled. The constricted portion 64 is located between head 61 and external thread 62 and slides freely into internal thread 52 of bridge 5. Another variant, with no internal thread, can be accomplished, in a reverse configuration of the first variant of FIG. 1.

Figure 4:
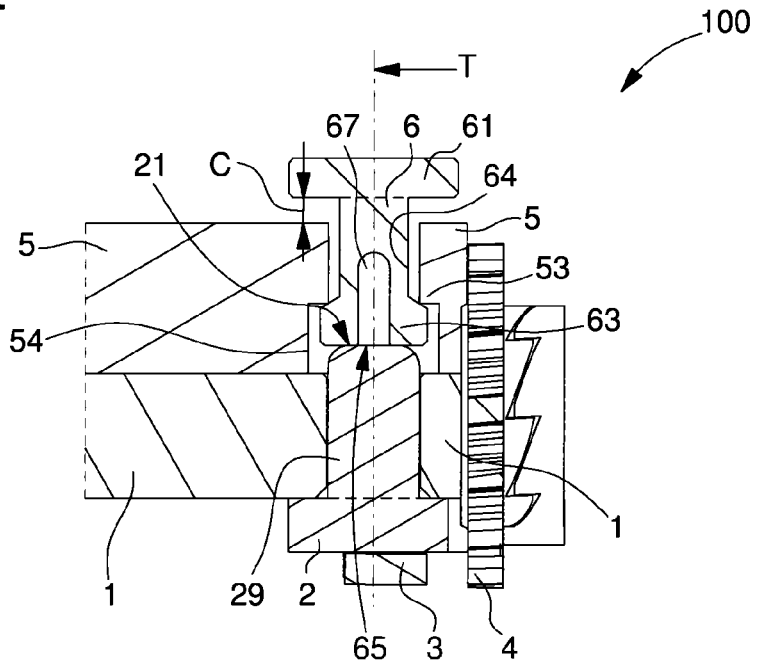
FIG. 4 shows, in a similar manner to FIG. 1, a fourth variant of the invention, wherein the limiter piston includes an elastic portion, forcibly inserted by compression in a chamber arranged between a shoulder of the bridge and the main plate, and confined in said chamber after the release of said elastic portion.
Figure 5:
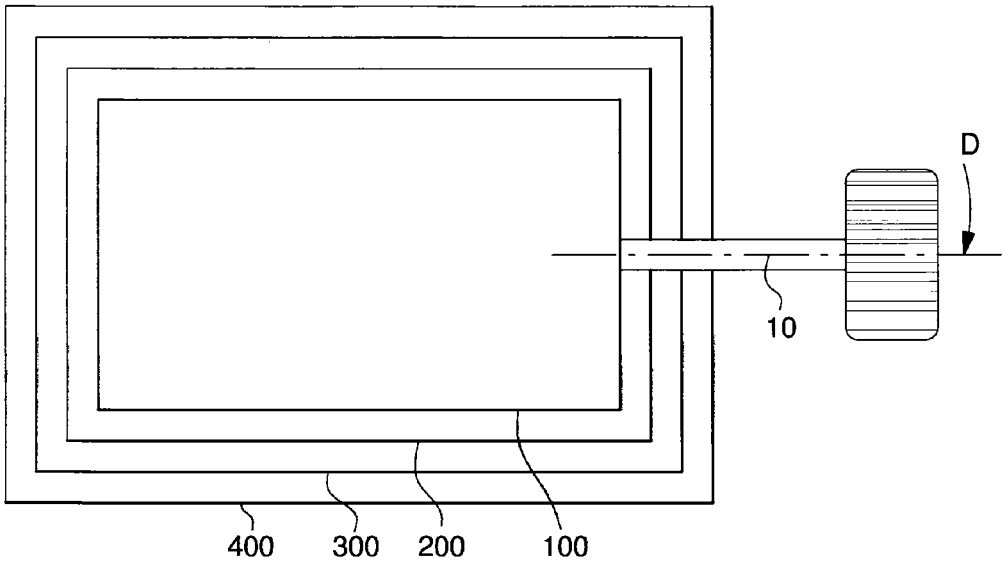
FIG. 5 is a block diagram showing a watch including a movement which includes a winding and time-setting mechanism, which includes a control mechanism according to the invention.

In a fourth variant shown in FIG. 4, in order to simplify machining operations as much as possible, a limiter piston including an elastic portion is used, particularly with a slot: limiter piston 6 includes at least one slot 67, is deformed when inserted into the extraction hole, and then remains confined in the housing when it returns to its original geometry. Depending on the geometry of the part, it may or may not be impossible to dismantle, depending on the type of the calibre in which it is used. Thus, limiter piston 6 is at least partly elastic, and housing 54 includes a shoulder 53 arranged, after insertion into housing 54 via the compression of at least one elastic area 63 of limiter piston 6, to immobilise this elastic area 63 when returned to the free state between said shoulder 53 and main plate 1. Another variant, which is not illustrated, consists in inserting limiter piston 6 in the other direction, with the elastic portion remote from the pull-out piece trunnion.

In a conventional manner, trunnion 29, like pull-out piece stud 20, which preferably extend in parallel directions, are movable in transverse direction T. Jumper spring 3 allows pull-out piece 20 a transverse travel with respect to longitudinal direction D under the application of a force in transverse direction T by limiter piston 6 to enable stem 10 to be removed or inserted.

Naturally, it is possible to push pull-out piece 2 other than on its pivot point. This solution is preferred since it limits the force to be applied, and does not deform the pull-out piece.

The invention also concerns a winding and time-setting mechanism 200 including such a control mechanism 100.

The invention also concerns a timepiece movement 300 including at least one such control mechanism 100 and/or one such winding and time-setting mechanism 200.

The invention also concerns a watch 400 including at least one such control mechanism 100 and/or one such winding and time-setting mechanism 200 and/or one such timepiece movement 300.

In short, the invention makes it possible to minimise the risks of damaging the mechanism when the stem is removed. Limiting the travel of the limiter piston ensures this safety function.

The invention provides numerous advantages:

- simplifying the manufacture of the bridge containing the extraction hole;
- limiting the travel of the pull-out piece trunnion by means of a simple part (a bar turned or cold worked part);
- protecting the toothings of the manual winding mechanism.

What is claimed is:

1. A control mechanism for a timepiece movement, including, in a housing of a main plate comprised in said mechanism, a control stem which is movable in a longitudinal direction, said stem including a groove cooperating with a stud comprised in a pull-out piece for actuating the pivoting of said pull-out piece on said main plate, said pull-out piece being held in position by a jumper spring, and said mechanism including a bridge cooperating with said main plate to confine said stem, wherein said control mechanism includes a means of limiting the travel of said stud of said pull-out piece, via a travel limiter including a limiter piston, said bridge includes a housing in which said limiter piston has limited mobility, said limiter piston is arranged to abut on one end of a trunnion comprised in said pull-out piece under the application of a force in a transverse direction substantially orthogonal to said longitudinal direction, to permit the release of said stem after a given travel of said limiter piston, and wherein the mechanism includes a limiter bridge which is fixed or abuts on said bridge to immobilise and confine a head of said limiter piston within the limit of said travel.

2. The mechanism according to claim 1, wherein said limiter bridge includes an orifice allowing the passage of a tool to apply a force in said transverse direction on said limiter piston.

3. The mechanism according to claim 1, wherein said housing includes a shoulder arranged, after insertion thereof into said housing by compressing at least one elastic area of said limiter piston, to immobilise said elastic area returned to the free state between said shoulder and said main plate.

4. The winding and time-setting mechanism including a control mechanism according to claim 1.

5. The timepiece movement including at least one winding and time-setting mechanism according to claim 4.

6. The watch including at least one timepiece movement according to claim 5.

7. The control mechanism for a timepiece movement, including, in a housing of a main plate comprised in said mechanism, a control stem which is movable in a longitudinal direction, said stem including a groove cooperating with a stud comprised in a pull-out piece for actuating the pivoting of said pull-out piece on said main plate, said pull-out piece being held in position by a jumper spring, and said mechanism including a bridge cooperating with said main plate to confine said stem, wherein said control mechanism includes a means of limiting the travel of said stud of said pull-out piece, via a travel limiter including a limiter piston, said bridge includes a housing in which said limiter piston has limited mobility, said limiter piston is arranged to abut on one end of a trunnion comprised in said pull-out piece under the application of a force in a transverse direction substantially orthogonal to said longitudinal direction, to permit the release of said stem after a given travel of said limiter piston, and wherein said housing includes an internal thread arranged to cooperate with an external thread comprised in said limiter piston on at least part of the height thereof in said transverse direction, said limiter piston includes a head for limiting said clearance travel thereof with respect to said bridge.

8. A mechanism according to claim 7, wherein said external thread and said internal thread are limited to an initial travel of said limiter piston, remote from said trunnion after said initial travel said limiter piston is free to pivot and come into contact with said trunnion.

9. The mechanism according to claim 7, wherein said head is confined between said internal thread and said main plate.

10. The mechanism according to claim 7, wherein said housing includes a shoulder arranged, after insertion thereof into said housing by compressing at least one elastic area of said limiter piston, to immobilise said elastic area returned to the free state between said shoulder and said main plate.

11. The winding and time-setting mechanism including a control mechanism according to claim 7.

12. The timepiece movement including at least one control mechanism according to claim 7.

13. The watch including at least one timepiece movement according to claim 12.

* * * * *